US008408969B2

(12) United States Patent
Mase

(10) Patent No.: US 8,408,969 B2
(45) **Date of Patent: *Apr. 2, 2013**

(54) ABRASIVE FOR BLAST PROCESSING AND BLAST PROCESSING METHOD EMPLOYING THE SAME

(75) Inventor: Keiji Mase, Tokyo (JP)

(73) Assignee: Fuji Manufacturing Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/463,913

(22) Filed: May 4, 2012

(65) Prior Publication Data

US 2012/0231704 A1 Sep. 13, 2012

Related U.S. Application Data

(62) Division of application No. 12/143,896, filed on Jun. 23, 2008, now Pat. No. 8,197,302.

(30) Foreign Application Priority Data

Jul. 4, 2007 (JP) ..... 2007-175930

(51) Int. Cl.
*B24C 11/00* (2006.01)

(52) U.S. Cl. ..... 451/36; 451/38; 451/330

(58) Field of Classification Search ..... 451/32, 451/34, 35, 330

See application file for complete search history.

(56) References Cited

U.S. PATENT DOCUMENTS

| | | | | | |
|---|---|---|---|---|---|
| 2,947,124 | A * | 8/1960 | Madigan et al. | 451/35 |
| 3,613,317 | A * | 10/1971 | Kittredge et al. | 451/330 |
| 3,808,747 | A * | 5/1974 | Kenagy | 451/330 |
| 4,877,638 | A * | 10/1989 | Novak et al. | 427/8 |
| 5,140,783 | A * | 8/1992 | Hoffman | 451/32 |
| 5,507,685 | A * | 4/1996 | Hoffman | 451/34 |
| 5,601,475 | A * | 2/1997 | Stametz et al. | 451/35 |
| 6,165,059 | A * | 12/2000 | Park | 451/330 |
| 7,695,346 | B2 * | 4/2010 | Ishibashi et al. | 451/39 |
| 8,197,302 | B2 * | 6/2012 | Mase | 451/32 |
| 2006/0099888 | A1 * | 5/2006 | Ishibashi et al. | 451/38 |

FOREIGN PATENT DOCUMENTS

| | | | |
|---|---|---|---|
| JP | 03060631 | B2 | 3/1991 |
| JP | 09314468 | A | 12/1997 |
| JP | 2000210869 | A | 8/2000 |
| JP | 2001207160 | B2 | 7/2001 |
| JP | 2003266313 | A | 9/2003 |
| JP | 2006123151 | A | 5/2006 |

* cited by examiner

*Primary Examiner* — Maurina Rachuba
(74) *Attorney, Agent, or Firm* — Porzio, Bromberg & Newman, P.C.

(57) ABSTRACT

An abrasive has a plate shape with a flat surface, in which a maximum diameter of the flat surface thereof is in the range of 0.05 mm to 10 mm, and 1.5 to 100 times as the maximum diameter as thick of the abrasive, and the blast processing method is one in which this abrasive is ejected by being inclined at an incident angle with respect to a surface of a product to be treated. The ejected plate-shaped abrasive slides along the surface of the product to be treated while having the flat surface in slidable contact with the surface of the product to be treated which is an object surface to be treated, so that the surface of the product to be treated is flattened by removing the peaks only, without increasing the depth of the valleys of the roughness curve.

13 Claims, 8 Drawing Sheets

ABRASIVE FOR BLAST PROCESSING AND BLAST PROCESSING METHOD EMPLOYING THE SAME

CROSS-REFERENCE TO RELATED APPLICATION

This application is a divisional of U.S. patent application Ser. No. 12/143,896 filed Jun. 23, 2008, now U.S. Pat. No. 8,197,302, which claims priority on Japanese Patent Application No. 2007-175930 filed Jul. 4, 2007, both of which applications are hereby incorporated in their entireties by reference into this application.

BACKGROUND OF THE INVENTION

1. Field of the Invention

The present invention relates to an abrasive employed in blast processing and a blast processing method employing the abrasive. More specifically, the present invention relates to an abrasive for blast processing employed for processing a surface of a workpiece by blast processing so as to provide a smooth finish, a mirror-like finish, a luster-like finish, a glossy finish, etc., and to a blast processing method employing this abrasive in order to provide a smooth finish, a mirror-like finish, a luster-like finish, a glossy finish, etc.

Moreover, the "blast processing method" of the present invention not only includes an air blasting method, such as a wet blasting method or dry blasting method, in which a compressed fluid containing compressed air, etc. is utilized in the ejection of the abrasive, but may also include a wide variety of blasting methods whereby the abrasive is ejected at a predetermined ejection speed and ejection angle with respect to the processing surface of the workpiece, such as a centrifugal-type method (impeller-type), in which an impeller is rotated to provide centrifugal force to the abrasive for ejection thereof; or a stamping-type method, etc., in which a stamping rotor is used to stamp down on the abrasive for the ejection thereof.

2. Description of the Related Art

In a process in which a tool bit, an end mill, a milling cutter, a gear hob, a broach, etc., is employed as a cutting tool, the area that can be cut in one pass is limited by the dimensions of the geartooth width of the cutting tool, etc. Accordingly, when a cutting process is conducted on a relatively large area on the workpiece, the cutting tool must be repeatedly fed at a predetermined pitch, and the process must be continued a plurality of times, in order to widen the cutting area thereof.

Therefore, in a processed cut surface of a product that was cut in said manner, processing indentations, referred to as "cut marks" or "tool marks", etc., arise in response to the feed pitch of the abovementioned cutting tool, causing uneven portions ranging from a few microns up to 1 mm to be formed therein (see FIGS. 1, 4 and 5).

When the product in which these processing indentations have occurred is assembled as is into a device as a component thereof, etc., the irregularities among the uneven portions that were caused by processing indentations during the continued usage of said device are worn down and cut, to reduce a protruding length thereof. Accordingly, the overall size of said component is also reduced, which thereby generates excessive clearance between the product and other elements and leads to problems, such as being unable to achieve the desired performance.

Thus, as described above, the processing indentations that occurred during the cutting process must be removed, in order to flatten the surface of the product after the cutting process.

Moreover, when the object of processing is a metal mold, the processing of this mold is generally conducted via a cutting process performed by a machining center, or an electro-discharge machining method. However, since the surface roughness of a mold that is processed by these methods is increased after the surface of the mold is processed via a machining center or electro-discharge machining, it must be smoothed to the desired surface roughness.

This smoothing process is conventionally conducted by polishing with an abrasive, such as abrasive paper or abrasive cloth, or a grindstone, etc.; or polishing with a buff; lapping; polishing by the contact between rotating abrasive grains; polishing by the contact between abrasive grains to which an ultrasonic vibration has been applied, etc. However, since these operations are typically performed manually, they require a skilled operator, as well as a considerable amount of time.

Moreover, the condition of the finished product differs depending on the skill of each respective operator. Furthermore, when the product to be treated has a complicated shape, the processing thereof becomes extremely difficult. Accordingly, the automatization of these flattening processes, a reduction in the costs thereof, and the prevention of variations in processing accuracy are also needed.

In addition, with regard to a metal mold for injection molding to resin, an edge portion of a parting surface of the metal mold is sometimes lost thus rounded depending on the method of manufacturing the metal mold. Therefore, when injection molding is performed using such mold, the resin injects into the edge portion thereof, as a result, irregularities or linear burrs are formed in the portions into which the resin injects after the molded product is released.

The irregularities or burrs that arise in the molded product are manually removed by an operator after molding, by cutting with a cutter or buffing out. However, not only is this manually operated process inefficient, but it is also unsafe, especially since this operation for removing the burrs or irregularities with a cutter risks injury to the operator of the cutter.

Accordingly, the development of a method whereby the above-described burrs or irregularities can be safely and efficiently removed is also highly desirable.

Moreover, by employing the blast processing in procedures such as polishing a surface of the metal mold and removing burrs, etc. that occur in the product, it allows the removal of burrs and polishing via the cutting force of the ejected abrasive grains. Said blast processing can be applied relatively easily, even in cases where the product to be treated has a complex shape.

However, with regard to the surface of a workpiece treated by a conventional blast processing method, when the abrasive grains are bombarded therewith, indentations are formed in the surface of the product. Therefore, since these indentations cause the formation of a satin-like finish on the surface, the blasting process cannot be applied to the desired objectives of smoothing the surface of the product after processing or providing the product with a mirror-like finish, but even if it could be applied, it would require a process whereby the satin-like finish that occurred from the blasting process after burr removal, etc., is additionally processed.

Accordingly, when conventional blast processing is performed, the surface of the product to be treated is provided with a satin-like finish, so that a smooth finish, mirror-like finish, luster-like finish, or glossy finish cannot be applied to the processed surface of the workpiece. On the other hand, a blast processing method that can be performed relatively easily, regardless of the shape of the product to be treated, etc., has the distinct advantage of being applicable even when the shape of the product to be treated is a relatively complicated shape.

Thus, the present invention provides a novel abrasive for blast processing in which a smooth finish, a mirror-like finish, a luster-like finish, or a glossy finish is applied to the surface of the product to be treated, and a blast processing method employing this abrasive.

Moreover, a method for blast processing has also been proposed, in which an abrasive grain carried on a carrier consisting of an rubber elastic body, etc. (hereinafter, the abrasive in which an abrasive grain is carried on the elastic carrier in this manner will be referred to as "elastic abrasive") is employed, and by ejecting this elastic abrasive onto the surface of the product to be treated at an angle, the impact from the abrasive colliding with the product to be treated is absorbed by the elastic deformation of the carrier, to prevent the formation of indentations, and thus a satin-like finish, and to allow the abrasive to slide along the surface of the product to be treated, so that a flat, or mirror-like finish, etc., can be provided.

Moreover, with respect to said carrier formed of rubber, serving as said elastic body is a grinding method for grinding the surface of a workpiece with an abrasive powder by ejecting abrasive gains onto the surface of a workpiece at an angle oblique thereto, the abrasive grains being produced by adhering the abrasive powder to elastic porous carriers formed of natural vegetable fibers, and then mixed with an abrasive liquid, to impact on the surface of the workpiece, causing the abrasive grains to slide on the surface of the workpiece while the abrasive grains are allowed to deform (see Japanese Unexamined Patent Application Publication No. H9-314468, claim 1).

According to the abovementioned method, the abrasive grains slide on the surface of the workpiece by the lubricating action of the grinding liquid while elastically deforming the carrier when impacted on the surface of the workpiece, so that the workpiece can be smoothly finished over the distance the abrasive grains traveled (see Japanese Unexamined Patent Application Publication No. H9-314468, Paragraph [0006]).

Furthermore, with regard to the configuration of the elastic abrasive, problems exist in that when a carrier is formed of rubber, the surface of the product to be treated becomes satin-like (Japanese Patent No. 3376334, Paragraph [0003]), and when a carrier is formed of vegetable fibers, even though the surface to be abraded of the product to be treated is polished almost to a mirror-like finish when the carrier contains water, once the water within the carrier evaporates from heat generated at the time of polishing, thus reducing the elasticity and viscosity of the carrier, the product to be treated is provided with a satin-like finish, and the recovery rate of the carrier is decreased because of breakage of the carrier (Japanese Patent No. 3376334, Paragraph [0004]). Thus, a blast processing method employing an elastic abrasive is provided, in which an elastic abrasive comprises water-retaining carriers, onto which abrasive grains are adhered by the adhesive force associated with the water contained therein, the water-retaining carriers being formed of a gelatin containing an evaporation preventing agent (Japanese Patent No. 3376334, claim 1, and Paragraph [0004]).

As mentioned above, in a blasting method employing an elastic abrasive of the above-described conventional art, by employing an elastic abrasive in which an abrasive grain is carried on a carrier body, which is an elastic body, indentations are formed on the surface of the product to be treated, even when the elastic abrasive bombards with the product to be treated as a result of elastic deformation of the elastic abrasive. Accordingly, by sliding the elastic abrasive along the surface of the product to be treated, while preventing the surface of the product to be treated from becoming satin-like, a predetermined polishing process can be performed.

Thus, by performing the blast processing using the elastic abrasive, a luster-like finish or glossy finish can be provided to a post-processed surface of the product to be treated, and, when blast processing in conducted to a product in which processing indentations occurred in response to the feed pitch of the cutting tool, the height from the bottom of a valley (maximum valley depth) to the peak (maximum peak height) of the surface roughness can be reduced, so that the surface thereof can be made relatively flat with respect to the pre-processed surface condition.

However, with regard to a post-processed surface of a product in which the elastic abrasive is employed, as described above, even though the height of the roughness curve from the bottom of the valley to the top of the peak can be reduced, the appearance of the pattern of the peaks and valleys of the pre-processed roughness curve remains the same, even after processing.

Afterwards, it was confirmed that the depth of the valleys of the surface roughness of the post-processed product was deeper than that of the valleys of the surface roughness of the pre-processed product, and therefore, not only were the peaks removed but the valleys were also cut deeper (refer to FIGS. 2 and 3).

The problem with blast processing employing this type of elastic abrasive is that, in order to completely eliminate all the irregularities in the surface of the product to be treated, along with cutting the peaks of the roughness curve, the valleys are also inevitably cut away, and thus deepened.

Moreover, if the processing time is increased in order to eliminate the surface irregularities, the amount of a product to be treated that is cut away is also increased, therefore making it difficult to process the product to be treated with the correct finished dimensions.

Accordingly, an object of the present invention, which has been made to solve the above problems of the related arts, is to provide the abrasive for blast processing and the blast processing method employing this abrasive, which is capable of eliminating the irregularities in the surface of a product to be treated that are difficult to eliminate by a conventional elastic abrasive, but also to prevent the formation of a satin-like finish on the surface of the product to be treated, in cases where the elastic abrasive of the present invention is employed.

SUMMARY OF THE INVENTION

In the following explanation of the Summary, reference numerals are referred as of the Embodiment in order to easily read the present invention, however, these numerals are not intended to restrict the invention as of the Embodiment.

To achieve the above object, an abrasive for blast processing of the present invention is characterized in having a plate shape with a flat surface, wherein a maximum diameter (MD) of the flat surface of said abrasive is in a range of 0.05 mm to 10 mm, preferably in a range of 0.1 mm to 8 mm, and the maximum diameter of the flat surface is 1.5 to 100 times, preferably 2 to 90 times a thickness (T) of said abrasive (MD=0.05 mm to 10 mm=1.5 to 100 T).

The abrasive with the above configuration may comprise a plate-shaped carrier with a flat surface, and an abrasive grain carried on at least one side of the flat surface of the carrier.

Further, as the carrier, a paper may be employed.

The abrasive grain may be carried on the carrier through an adhesive. Moreover, an abrasive grain may be dispersed in a plate shaped carrier with the flat surface.

When the abrasive grains are dispersed in the carrier, the carrier may be an elastic body such as rubber or resin material.

Moreover, in order to visually determine the grain size of an abrasive grain in the present invention, a colorant of such as a titanium oxide powder, a zinc oxide powder, a carbon black powder, a white carbon powder, a silica powder, a mica powder, or an aluminum powder, a metal flake; an iron oxide, an azo dye, an anthraquinone dye, an indigo dye, a sulfide dye, a phthalocyanine dye, etc.; or an inorganic or organic pigment, for example, may be employed. Moreover, a fluorescent colorant may be compounded with these into the abrasive, and an aromatic or anti-bacterial agent may be further compounded as well.

A blast processing method according to the present invention is characterized in that the abrasive having said configuration is ejected at an incident angle inclined with respect to a surface of a product to be treated.

A blast processing method according to the present invention is characterized in comprising ejecting an abrasive having a plate shape with a flat surface, wherein a maximum diameter (MD) of the flat surface is in a range of 0.05 mm to 10 mm, and the maximum diameter of the flat surface is 1.5 to 100 times a thickness (T) of said abrasive, at an incident angle inclined with respect to a surface of a product to be treated (MD=0.05 mm to 10 mm=1.5 to 100 T).

Preferably, the abrasive with a maximum diameter of the flat surface that is at least three times as the average interval of the irregularities appearing in the surface roughness (Sm), which is an average value of an interval between the valley and the peak determined by an intersection between an average line and the roughness curve may be used.

Specifically, as defined by JIS'94 Standards, a measuring length of 4.0 mm, a cut-off wavelength of 0.8 mm, an evaluation length of 4 mm, and a measuring speed of 0.3 mm/s are used as parameters.

Preferably, the ejection of the abrasive is conducted at an incident angle of 0<80 degrees with respect to the product to be treated.

With the above-described configuration of the present invention, the remarkable effects mentioned below can be obtained by employing the abrasive for blast processing and the blast processing method employing this abrasive.

When the abrasive of the present invention is ejected to bombard with the product to be treated, a flat surface thereof is slidably contacted with the surface of the product to be treated, and therefore, able to slide on a surface of the product to be treated.

Moreover, in the blast processing employing the abrasive of the present invention, cutting can be performed in which only the height of the peaks is reduced, without increasing the depth of the valleys appearing in the surface roughness of the product to be treated, and therefore, irregularities formed in the surface of the product to be treated, for example, irregularities caused by processing indentations that occurred during the cutting process, can be almost completely eliminated.

In cases where this type of abrasive for blast processing is one in which an abrasive grain is carried on a carrier formed in a plate shape, for example, the abrasive grain is carried on a raw material forming the carrier, such as paper, cloth, a resin film or sheet, a metal foil, a sheet of inorganic material, etc., so that afterwards, the abrasive for the blast processing of the present invention can be manufactured comparatively easily, via the cutting of this material, etc.

Specifically, in a configuration in which the abrasive grain is carried on a carrier via an adhesive agent, the abrasive for blast processing of the present invention can be easily manufactured by embedding or applying the abrasive grains in or to an adhesive layer formed by applying the adhesive agent to the raw material forming said carrier, or by applying the abrasive grains to the raw material formed from a premixed adhesive, followed by the abovementioned cutting process, etc.

In an abrasive configuration in which the abrasive grains in the carrier are dispersed, even in cases where so-called "shedding" occurs, in which the abrasive grains on a surface portion thereof fall off due to contact with the product to be treated, when the carrier is worn out from being in contact with the product to be treated, the abrasive grains buried therein are exposed at the surface, so that the cutting force can recover. Specifically, in cases where the elastic body of the present invention is employed as the carrier, said remarkable action was appeared, making it possible to provide an abrasive that is also capable of withstanding repeated usage.

Moreover, in the blast processing method of the present invention, by employing an abrasive with a diameter that is at least three times as the average interval of the irregularities appearing in the surface roughness (Sm), intrusion of the abrasive into the valleys of the surface roughness can be almost completely prevented, to thereby prevent deepening of the valleys, and allowing the smoothness of a processed surface thereof to be improved.

Moreover, by ejecting the abrasive at an incident angle of 5 degrees to 70 degrees with respect to the product to be treated, the sliding of the abrasive along the surface of the product to be treated can be facilitated.

BRIEF DESCRIPTION OF THE DRAWINGS

The objects and advantages of the invention will become apparent from the following detailed description of preferred embodiments thereof provided in connection with the accompanying drawings in which.

DETAILED DESCRIPTION OF THE PREFERRED EMBODIMENTS

Figure 1:
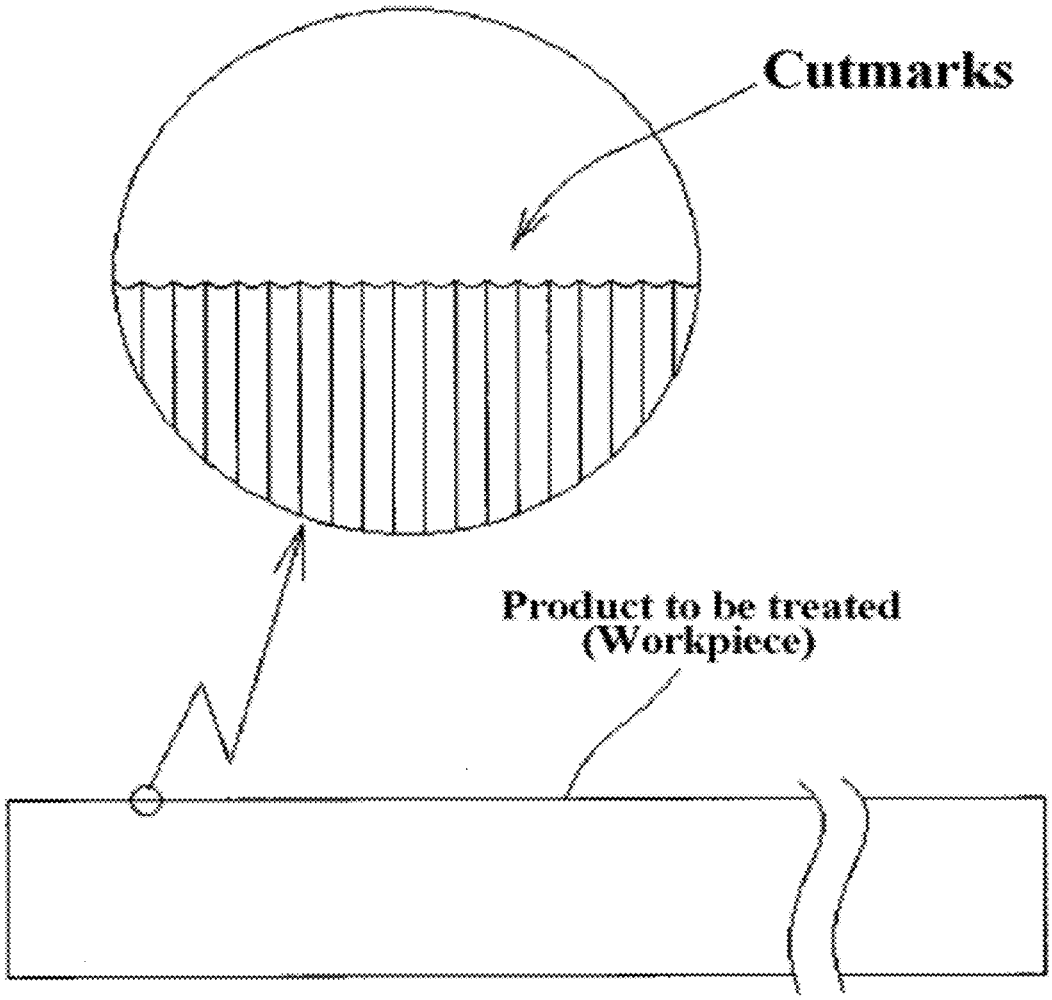
FIG. 1 is an explanatory view of a product to be treated (workpiece) of Example 1 and Comparative Example 1.

Hereinafter, the embodiments of the present invention will be described with reference to the drawings.

Abrasive

Overall Structure

An abrasive for blast processing of the present invention is formed into a plate-shape having a flat surface, and has a flat shape, with a plate diameter thereof formed to be relatively large with respect to the thickness thereof.

Here, "plate diameter" indicates the maximum diameter in the shape of the flat surface of the abrasive. For example, the "plate diameter" may respectively represent the diameter, in cases where the flat surface of the abrasive is circular-shaped; the length, in cases where the flat surface of the abrasive is elliptical-shaped; the diagonal length, in cases where the flat surface of the abrasive is rectangular-shaped; and the maximum diameter measurement as determined by the flat surface shape of the respective abrasive, in cases where the shape is irregular.

The plate thickness indicates the average thickness of the abrasive. Specifically, hereinafter it is "the coating thickness of abrasive grains+the thickness of the carrier".

As one method for determining the plate diameter, the plate diameter may be measured based on a scanning electron micrograph (SEM micrograph). For example, the measurements may be taken from the dimensions obtained from the image coordinates of digitized image data of an SEM micrograph of the abrasive of the present invention.

Moreover, the average value may also be measured via the dimensions obtained from a predetermined number of samples (for example, 100 samples) selected at random, with the resulting average value thereof being defined as the plate diameter. A similar method may also be employed to determine the plate thickness.

The average plate diameter of the abrasive of the present invention is in the range of 0.05 mm to 10 mm, and more preferably in the range of 0.1 mm to 8 mm.

The flatness of the abrasive can be determined by the ratio of the plate diameter to the thickness of the abrasive, which in the present embodiment is referred to as "plate ratio", given by "plate diameter/thickness".

The desired plate ratio in the abrasive of the present invention is from 1.5 to 100, and preferably from 2 to 90.

In cases where an abrasive with a plate diameter smaller than 0.05 mm is employed, even if the abrasive is formed into a plate shape, since the ejected abrasive slides along a rough surface of the workpiece (for example, irregularities such as cut-marks), even if the height from the bottom of the valleys to the top of the peaks of the surface roughness can be somewhat reduced, the irregularities caused by deepening the bottom of the valleys cannot be eliminated, which makes processing into a flat shape difficult. Accordingly, the plate diameter of the abrasive, as mentioned above, is set to be no less than 0.05 mm.

Moreover, when the plate diameter of the employed abrasive is more than 10 mm, the ejection of such an abrasive becomes difficult. For example, in cases where this type of abrasive is ejected via a nozzle along with a compressed gas, the diameter of the nozzle employed in the ejection thereof is increased in response to the increased plate diameter of the abrasive, so that the nozzle portion and the tube diameter of the ejection hose required for the nozzle portion are also increased. In cases where the nozzle is manually operated, this adversely affects the operability thereof. Accordingly, the plate diameter of the abrasive is preferably no more than 10 mm, as described above.

The plate ratio is expressed as: plate ratio=plate diameter/plate thickness (the thickness of the carrier+the coating thickness of the abrasive grains). Therefore, when the plate diameter is 10 mm and the plate thickness is 0.1 mm, plate ratio=plate diameter/plate thickness=10/0.1=100. Here, the grain diameter of the employed abrasive grains is 1 mm to 0.1 μm, for example.

Moreover, the reason for having the plate ratio in a range of 1.5 to 100 is that when the plate ratio is no less than 1.5, and when the abrasive is ejected and bombards with the surface of the product to be treated, it is possible to achieve a sliding orientation in which this flat surface of the abrasive makes slidable contact with the surface of the product to be treated with a high degree of probability, so that processing thereof can be efficiently performed by sliding the abrasive along the surface of the product to be treated in this orientation. On the other hand, when the plate ratio is less than 1.5, the number of the abrasive being in an orientation in which the flat surface thereof slides on the surface of the product to be treated via the collision with the product to be treated is decreased, which thereby decreases the processing efficiency.

When the plate ratio exceeds 100, the end of the abrasive ejected from the nozzle frequently curves, buckles, or breaks due to air resistance, or when bombarded on the surface of the workpiece.

Moreover, in order to flatten said surface cut-marks, by utilizing the abrasive of the present invention, the plate diameter, plate ratio, and rigidity may also be calculated based on the surface roughness thereof. Specifically, these values may be calculated from Rz (average roughness of ten points), Sm (average irregularity interval), S (average interval between the adjacent peaks), and Pc (Peak count).

Specifically, the plate diameter of the abrasive employed is at least as large as Sm (average irregularity interval) for the surface roughness of the product to be treated which is an object of processing preferably no less than three times as large, and more preferably no less than ten times as large. By employing this type of abrasive, the intrusion of the abrasive into the bottom of the valleys of the surface roughness can be prevented, which thereby prevents the exertion of the cutting force of the abrasive from deepening the bottom of the valleys of the surface roughness. Moreover, the roughness shape parameters are as defined in JIS B0601-1994.

The abrasive is capable of demonstrating flexibility or deformability. This type of flexibility or deformability may be achieved by employing an abrasive having the flexible or deformable carrier described below.

By providing an abrasive with this type of flexibility or deformability, the indentations, etc. that are formed on the surface of the product to be treated when the abrasive bombards with the surface of the product to be treated can be prevented.

The shape of the abrasive of the present invention is not specifically limited in any way so long as it is formed in a flat plate shape, as described above. For example, the shape may be selected from a circular shape or semi-circular shape, an elliptical shape, a triangular shape, a rectangular shape, other polygonal shapes, an irregular shape, etc., or any shape employing a combination of shapes selected therefrom.

Moreover, any of the configurations described below may be employed as the configuration of the abrasive employed by the present invention.

(1) An abrasive formed into a plate shape with the abrasive grains themselves having the flat surface (hereinafter, an abrasive with this type of configuration will be referred to as the "integrated abrasive grain type");

(2) an abrasive in which the abrasive grains are carried on one or both surfaces of the plate-shaped carrier having the flat surface (hereinafter, an abrasive with this type of configuration will be referred to as the "carried abrasive grain type"); and (3) an abrasive in which the abrasive grains are dispersed in the material forming the carrier, and the carrier with the abrasive grains dispersed therein are formed into a flat shape with a flat surface (hereinafter, an abrasive with this type of configuration will be referred to as "dispersed abrasive grain type").

The "carried abrasive grain type" among the above-indicated types of abrasives may be consisted of different materials such as the grain type, grain diameter, distribution, etc. carried on one surface of the carrier from those of the abrasive grains carried on the other surface.

Moreover, in this "carried abrasive grain type" abrasive, in addition to the abrasive grains carried on only one side of the carrier, a material that exerts a function which is different from that of these abrasive grains may be carried on the other surface, for example, a coloring agent, an anti-rust agent, a lubricant, a spherically-shaped bead with a varnishing function, etc., making it possible to provide the abrasive with the function possessed by such a carried material.

Moreover, as the above-described "integrated abrasive grain type" abrasive, it is possible to form a metal, such as aluminum, copper, iron, tin, zinc, etc., or an alloy thereof; or fiber, resin, ceramic, or any composite thereof into a shape having a flat surface, to provide the abrasive of the present invention.

Carrier

In the configurations of the abrasive of the present invention configured as described above, the carrier for carrying the abrasive grains is included in the "carried abrasive grain type" and "dispersed abrasive grain type" abrasives, but is omitted from the "integrated abrasive grain type" abrasive.

Hereinafter, examples of such types of carriers will be described in greater detail.

"Carried Abrasive Grain Type"

In a "carried abrasive grain type" abrasive, in which the abrasive is constructed to have the abrasive grains carried on one or both surfaces of a plate-shaped carrier, so long as a sheet-shape or film shape thereof is formed to have a thickness of approximately 0.001 mm to 5 mm, any types of materials can be employed without restricting materials thereof or the like.

For example, a sheet or film of paper, cloth, non-woven fabric, rubber, plastic, a fiber material, a resin, or another type of organic material; a foil or plate composed of a metal such as, aluminum, tin, copper, zinc, iron, etc., or any alloy thereof; or a sheet of inorganic material, such as glass, alumina, ceramics, etc., may be employed in this type of carrier.

"Dispersed Abrasive Grain Type"

When forming the abrasive of the present invention by forming a plate shape from the material forming the carrier on which the abrasive grains are carried, various types of materials may be employed as the carrier of the "dispersed abrasive grain type" abrasive, so long as the material is capable of having the abrasive grains dispersed therein and is capable of being formed into the plate shape while the abrasive grains are dispersed therein, for example, rubber, or plastic, etc., may be appropriately employed.

Moreover, as the material forming the carrier, the abrasive of the present invention may employ a known material used a grindstone bonding agent, such as a vitrified bonding agent, a silicate bonding agent, a resinoid bonding agent, a rubber bonding agent, a vinyl bonding agent, a shellac bonding agent, a metal bonding agent, an oxychloride bonding agent, etc., with the abrasive grains dispersed therein and formed into a plate shape.

Abrasive Grains

As said abrasive grains, as well as being brought into contact with the product to be treated so that the product to be treated may be processed into a predetermined state, etc., so long as the abrasive grains employed in the "carried abrasive grain type" abrasive are grains that can be carried on the carrier through an adhesive, etc., and so long as the abrasive grains employed in the "dispersed abrasive grain type" abrasive are grains that can be dispersed in the material forming the carrier, a variety of abrasive grains may be employed, without the material, shape, or dimensions thereof, etc., being limited in any way.

Various materials generally used as abrasives may be employed; for example, alumina such as, white alundum (WA) or alundum (A), etc.; green carborundum, diamond, etc.; c-BN, boride, carbon boride, titanium boride, cemented carbide allay, etc.; as indicated in Table 1 below.

Moreover, any mixture of two or more of these abrasive grains may also be employed.

TABLE 1

Examples of the Abrasive Grains Employed as the Abrasive of the Present Invention

| | |
|---|---|
| Plant-based | Corn core; seed hull of walnut, peach, nuts, apricot, etc.; pulp; cork |
| Metals | Iron, steel, cast iron, cobalt, nickel, gallium, zirconium, niobium, molybdenum, rhodium, palladium, silver, indium, tin, antimony, zinc, stainless steel, titanium, vanadium, chromium, aluminum, silicon, $MnO_2$, $Cr_2O_3$, or alloys thereof |
| Ceramics | Glass, quartz, alundum, white alundum, carborundum, green carborundum, zircon, zirconia, garnet, emery, carbon boride, titanium boride, aluminum-magnesium, boride, or boride nitride |
| Inorganic materials | Calcium carbonate, calcium sulfate, or calcium fluoride, barium sulfate, barium chloride, aluminum sulfate, aluminum hydroxide, strontium carbonate, strontium sulfate, strontium chloride, titanium oxide, basic magnesium carbonate, magnesium hydroxide, carbon, graphite, graphite fluoride, molybdenum disulfide, or tungsten disulfide |

The particle size of said abrasive grains is also not limited in any particular way, and therefore, may vary depending on the objective of the processing, etc.; for example, the abrasive grain with an average grain diameter in the range of 1 mm to 0.1 μm may be employed. Moreover, in cases where a mirror finish is applied by glossing the processing surface of the workpiece, the employment of fine abrasive grains with an average grain diameter of no more than 6 μm (#2000 or greater) is preferable. In the abrasive of the present invention, fine abrasive grains with an average grain diameter of no more than 1 μm (#8000 or greater) may be employed.

Moreover, in cases where the processing surface of a workpiece is to be cut and processed into a predetermined shape, rough abrasive grains with an average grain diameter of no less than 30 μm (#400 or less) may be employed, or in the present invention, abrasive grains with an average grain diameter of 1 mm may also be employed.

Although the abrasive grains may have up to approximately half the grain diameter thereof exposed, in such cases, the degree of exposure from the carrier of the abrasive grains is preferably 10% to 50% of the grain diameter thereof. With abrasive grains in which the degree of exposure is less than 10%, the length of the abrasive grain involved in processing is reduced, so that the abrasive force thereof is reduced, and the working efficiency thereof is poor. With abrasive grains in which the degree of exposure is more than 50%, the surface area of the abrasive grains carried on (embedded in) the carrier is reduced, which causes the retaining strength of the abrasive grains in the carrier to be reduced, so that the abrasive grains fall off the carrier during processing, thereby preventing processing uniformity from being maintained. Moreover, the durability of the abrasive is poor, and the cost is high. Accordingly, the degree of exposure is preferably from 20% to 40%.

When the "carried abrasive grain type" abrasive is manufactured, the fixation or carry of the abrasive grains to or in the carrier may be performed through an adhesive, which in such cases may be any conventionally employed adhesive used for the fixation or carry of abrasive grains on abrasive paper or abrasive cloth, for example.

For example, an epoxy resin adhesive, a polyurethane resin adhesive, an acrylic adhesive, a silicon adhesive, a rubber adhesive, a cyanoacrylate adhesive, a hot melt adhesive, or an ultraviolet light curing adhesive may be employed as this adhesive.

Manufacturing Method of the Abrasive

Hereinafter, examples of the manufacturing methods for each type of adhesive will be described in greater detail.

"Integrated Abrasive Grain Type"

A metal, such as aluminum, copper, iron, tin, zinc, etc. and alloys thereof, formed into a plate or foil shape by rolling or the like; a resin formed into a plate shape or film shape; a ceramic plate; or a fabric, non-woven fabric, etc. is cut so as to have a predetermined plate diameter to form the abrasive of the present invention.

Moreover, a fabric-type abrasive is adhesively affixed to the above-mentioned adhesive with a predetermined thickness, so that the shape of the fiber is retained, without fraying during the manufacturing processing. Afterwards, it is cut to the required shape and dimensions.

"Carried Abrasive Grain Type"

Manufacturing Method 1

A conventional coating device, such as a knife coater, etc., is employed to apply a coating of a composition having a weight ratio of compounded abrasive grains to adhesive agent of 1:0.2 to 1:2.0, and a post-application dried thickness of 2 μm to 2000 μm, to one or both surfaces of a 1 μm to 5000 μm thick foil, sheet, or film, etc. serving as the carrier, which is subsequently dried and cut to a predetermined plate diameter to form the abrasive of the present invention.

Manufacturing Method 2

An adhesive is applied so as to provide a 5 μm to 4000 μm thick coating on one or both sides of the carrier, and abrasive grains are adhered to the adhesive layer before the curing of the adhesive to carry the abrasive grains on the surface of the carrier.

In this manner, the carrier on which the abrasive grains are carried is cut to a predetermined plate diameter to provide the abrasive of the present invention.

Manufacturing Method 3

In cases where a comparatively soft metal, such as aluminum, etc., or an elastic body, such as rubber, resin, etc., is employed as the carrier, the desired amount of the abrasive grains is dispersed on the carrier formed into the plate shape from the above materials, with the abrasive grains being embedded into the surface of the carrier by pressing the top of the abrasive grains dispersed thereon.

In this manner, the carrier on which the abrasive grains are carried is cut into a predetermined plate diameter, to provide the abrasive of the present invention.

"Dispersed Abrasive Grain Type"

The materials forming the abrasive grains and the carrier, for example, the resin material composing the carrier, is compounded at a ratio of 10 wt % to 40 wt %, with respect to 60 wt % to 90 wt % of the abrasive grains, and is then formed into a plate shape and cut to the predetermined plate diameter, to form the abrasive of the present invention.

For example, in cases where the carrier is composed of rubber, after an initial masticating process is conducted, the raw rubber material is kneaded. In the kneading step, the abrasive grains as well as the compounding agent may also be added.

Next, the raw material whose plasticity has been adjusted by the kneading of the compounding agent or the abrasive grains is processed into a sheet-like shape or flat plate-like shape using an extruder, etc., equipped with a screw, or using a calender formed by arranging a plurality of rollers, with the molding process therefor being subsequently continued until the material is in a moldable state.

The raw material that is processed into a plate shape is kept in a plate shape during the molding process, and is cut to a predetermined size and shape to obtain fragments with a predetermined plate diameter. Afterwards, the fragments obtained by the molding process are heat treated by a vulcanizing process to initiate a cross-linking reaction caused by a vulcanizing agent contained within the fragments, and a portion except for the abrasive grains is then processed into the elastic body. Moreover, various types of conventional devices can also be employed in the vulcanizing process, for example, an extrusion-type, a vulcanizing can-type, or a press-type continuous vulcanizer, etc.

Moreover, the molding (molding process) into the fragments and the subsequent cross-linking via vulcanization (vulcanizing process) may also be performed in the reverse order. For example, the raw material that is processed into a plate shape from the extrusion process or rolling process may also be transferred, as is, to a vulcanizing process, where it is processed into an elastic body, and afterwards cut during a molding process.

Moreover, in cases where a thermoplastic elastomer is employed as the abovementioned polymer raw material, the manufacturing may be by a conventional thermoplastic elastomer manufacturing process, whereby, first a kneading process is conducted once the compounding agent and the abrasive agent have been added to a mixed polymer raw material, then the milled raw materials are heated to a temperature greater than or equal to the melting points thereof, next a molding process is conducted so that the molten raw materials are formed into a plate shape by extrusion or injection, etc., and finally, the plate-shaped body formed thereby is cut into a predetermined plate diameter by a cutting process, to thereby produce the abrasive. Examples of equipment that can be used in the kneading process described above are rollers, pressure kneaders, internal mixers, etc.

Blast Processing Method

The abrasive of the present invention obtained by the above-mentioned manufacturing methods may undergo a flattening process, such as the application of a smooth finish, a mirror-like finish, a luster-like finish, or a glossy finish, etc., by performing blast processing which employs this abrasive.

Abrasive Ejection Method

In addition to an air blast processing method, such as wet blasting or dry basting, etc., whereby the abrasive is ejected by utilizing a compressed fluid, such as a compressed gas, etc., any method may be used as the abrasive ejection method, so long as it is capable of ejecting the abrasive at a predetermined ejection incident angle or ejection speed with respect to the processing surface of the workpiece, for example, a centrifugal-type method (impeller method), whereby an impeller is rotated to apply a centrifugal force to the abrasive, or a stamping-type method, whereby a stamping roller is employed to eject the abrasive by stamping, etc.

More specifically, it is preferable to eject the abrasive using a nozzle-based method in order to accurately eject the abrasive onto the targeted processing portion, with a large degree of freedom being provided in the selection of the ejection range and ejection portion, so that by processing the portion of the product to be treated in an affixed state via the movement of the direction towards which the nozzle is facing, an advantage is provided in that the processing thereof can be performed easily, even in cases where the product to be treated is heavy or large in size.

When the abrasive is ejected via a compressed fluid, in addition to a compressed gas, such as compressed air, etc., the abrasive may be ejected along with a compressed liquid such as water or an abrasive liquid.

Ejection Pressure and Speed

The ejection of the abrasive for blast processing is performed at an ejection speed of 5 m/s to 200 m/s, preferably 20 m/s to 150 m/s, or at an ejection pressure of 0.01 MPa to 1 MPa, preferably 0.02 MPa to 0.6 MPa.

When the ejection speed is more than 200 m/s, the surface of the product to be treated becomes satin-like due to the kinetic energy therefrom. Moreover, the carrier is damaged, the abrasive grains fall off, so that stable processing cannot be performed, and the durability of the abrasive is decreased, which thereby causes an increase in cost. When the ejection speed is less than 5 m/s, the processing performance is decreased, productivity is reduced, and the industrial applicability thereof is poor. Accordingly, an ejection speed of 20 m/s to 150 m/s is preferable. In cases where the ejection pressure is more than 1 MPa and compressed air is employed, the ejection speed becomes at least 200 m/s, and the surface becomes satin-like.

In addition, the carrier is damaged, the abrasive grain falls off, so that stable processing cannot be performed, and the durability of the abrasive is decreased, which thereby causes an increase in cost. Moreover, a high-pressure compressor is necessary as an air supply, and the costs of equipment and factories are increased. When the ejection pressure is less than 0.01 MPa, a sufficient abrasive speed cannot be obtained, so that the processing performance is decreased, the productivity is reduced, and the industrial applicability thereof is poor.

Incident Angle with Respect to the Product to be Treated

The ejection of the abrasive to the product to be treated is performed at an incident angle θ of 0<80 degrees with respect to the surface of the product to be treated, and preferably at an incident angle of 5 degrees to 70 degrees. As the incident angle becomes more acute, the abrasive can more easily slide on the surface of the product to be treated, and so that a flat minor-like surface can be easily obtained.

When the incident direction of the abrasive is given by angle θ with respect to the surface of the product to be treated, the velocity component perpendicular to the surface of the treated product is represented as V×Sin θ, and the velocity component parallel to the surface of the product to be treated is represented as V×Cos θ. In order to prevent a satin-like finish on the surface of the product to be treated, V×Sin θ must be small, and V×Cos θ must be large. Accordingly, 0=90 degrees must be avoided. Furthermore, a low angular direction of 0 degrees is undesirable in view of processing performance.

As mentioned above, when the abrasive of the present invention that is formed into a plate shape is ejected via a blast processing device so as to have the incident angle inclined with respect to the product to be treated, the ejected abrasive slides on the surface of the product to be treated, to polish the surface thereof.

When the abrasive of the present invention that is formed to have a plate ratio of 1.5 to 100 is ejected via the blast processing device and bombarded, it slides on the surface of the product to be treated in such a manner that the surface of the abrasive is in slidable contact with the surface of the product to be treated; therefore, the surface of the product to be treated that is in contact with the flat surface of the abrasive is cut and flattened.

The abrasive of the present invention that is formed to have a plate diameter of 0.05 mm to 10 mm does not easily inject into the valleys of the surface roughness of the product to be treated, and therefore, only cuts the peaks, without applying any cutting force in a direction that would increase the depth of the valleys. Accordingly, the surface of the product to be treated can be flattened easily.

Specifically, by making the plate diameter larger than the pitch of the irregularities of the product to be treated to be processed, preferably no less than three times as the pitch of the irregularities, and more preferably no less than ten times as the pitch of the irregularities, it is impossible for the movement of the abrasive to follow the shape of the pitch of the abovementioned irregularities, and thus, cutting in the direction of increasing depth of the valleys appearing in the surface roughness may be almost completely prevented.

Accordingly, with regard to the irregularities in the surface of the product to be treated, the areas centered on peaks of the surface roughness are scraped off, to process the surface thereof into a flattened shape, and to polish in accordance with the grain size or the material of the abrasive grains employed, or the product as the object of processing, so that the surface can be processed to have the desired finish, such as a mirror-like finish, luster-like finish, etc.

Hereinafter, Examples of the present invention will be described in greater detail.

Example 1

Abrasive

In the abrasive employed in the present example, a waterproof Kraft paper was employed as the carrier, and an epoxy resin adhesive with abrasive grains dispersed therein was coated thereon. One-side of the square-shaped abrasive was 1.5 mm.

The table below shows the details of the abrasive employed in Example 1.

TABLE 2

| Abrasive (Example 1) | |
|---|---|
| Shape and size | 1.5 mm × 1.5 mm square-shaped flat surface, Size etc. with a thickness of 0.25 mm |
| Plate diameter | 2.8 mm (average diameter of 100 randomly selected samples, as determined by SEM micrographs) |
| Plate Ratio | 11.2 (2.8 mm plate diameter/0.25 mm)* |
| Carrier | Graphite type (50 μm thickness; water-proof treated) |
| Abrasive Grains | Green carborundum (GC) #2000 (average abrasive grain diameter of 6.7 μm), manufactured by Fuji Manufacturing Co., Ltd. |
| Additional Production Methods | A compounded liquid that was obtained by compounding abrasive grains at a weight ratio of 1:1.5 (abrasive grains:adhesive agent) into an epoxy resin adhesive agent was applied with a knife coater to one side of a paper carrier, so that a dried thickness thereof was 0.2 mm. After drying, the carrier was cut into a 1.5 mm × 1.5 mm square shape. |

*The plate ratio was based on actual measurements via SEM observations

Moreover, the plate diameter in the abovementioned Table 2 is based on SEM micrographs of 100 randomly selected samples, with the plate diameter of each sample being measured as the diagonal length thereof, and the average value thereof determined as the abovementioned plate diameter.

Moreover, the plate ratio was the value determined by dividing the abovementioned average plate diameter value by the thickness.

Product to be Treated (Workpiece)

Table 3 shows a product to be treated employed as the subject of processing in the present example.

As indicated in Table 3, the product employed as the product to be treated (workpiece) of the present example was an S45C steel round bar (carburized product), with continuous cut-marks being formed in parallel in the circumferential direction, with a pitch of approximately 0.15 mm in the longitudinal direction (see FIG. 1).

Moreover, with regard to the product to be treated, before the blast processing employing the abrasive of the present invention was performed, shot peening treatment was conducted for surface preparation.

The table below shows the details of the abovementioned product to be treated (workpiece).

TABLE 3

| Product to be treated (Workpiece) | | |
|---|---|---|
| Material | | S45C steel carburized product |
| Shape and Size | | Round bar (30 mm diameter) |
| Hardness | | HRC45 |
| Pre-treatment | Method | Shot peening |
| | Device Used | "FD4", manufactured by Fuji Manufacturing Co., Ltd. (direct pressure air blasting device) |
| | Ejection Nozzle | 5 mm diameter |
| | Ejection Material | Cast iron shot (0.2 mm diameter) |
| | Ejection Pressure | 0.3 MPa |
| | Ejection Distance | 200 mm |

Conditions of Blast Processing Employing Plate-Shaped Abrasive

The above-described abrasive was ejected onto the same product to be treated (workpiece) as described above for conducting blast processing. The processing conditions of this blast processing are shown in Table 4.

TABLE 4

| Blast Processing Conditions (Example 1) | |
|---|---|
| Ejection Device | Air blasting device (gravity-type "SGSR-3"; Manufactured by Fuji Manufacturing Co., Ltd.) |
| Ejection Pressure | 0.1 MPa |
| Ejection Distance | 50 mm |
| Ejection Angle | 45 degrees with respect to axis of the workpiece |
| Treatment Time | 1 minute |
| Additional Conditions | A portion of the workpiece was masked by covering with tape, and the plate-shaped abrasive slid from the masked portion to the unmasked portion. |

Comparative Examples

With the same product to be treated (workpiece) as the abovementioned example as the subject, blast processing was conducted by employing an elastic abrasive with the grain shape described below.

The processing conditions and the elastic abrasive employed therein were as described below.

TABLE 5

| Elastic Abrasive (Comparative Example 1) | |
|---|---|
| Shape and Size | Grain with a 0.6 mm grain diameter |
| Carrier | Rubber |
| Abrasive Grains | Green carborundum (GC) #8000 (average abrasive grain diameter of 1.2 μm), manufactured by Fuji Manufacturing Co., Ltd. |

TABLE 5-continued

| Elastic Abrasive (Comparative Example 1) | |
|---|---|
| Production Method, etc. | A compounded material was obtained by adding and kneading compounding agent and abrasive grains to masticated rubber, with the abrasive grains being compounded at a weight ratio of 80% with respect to the total content of 100% of the mixture. The kneaded material was pulverized to form grains with a grain diameter of approximately 0.6 mm. The resulting grains were then vulcanized to produce the elastic abrasive employed in Comparative Example 1. |

TABLE 6

| Ejection Conditions of the Elastic Abrasive | |
|---|---|
| Ejection Device | Air blasting device (gravity-type "SGSR-3"; manufactured by Fuji Manufacturing Co., Ltd.) |
| Ejection Pressure | 0.08 MPa |
| Ejection Distance | 50 mm |
| Ejection Angle | 45 degrees with respect to axis of the workpiece |
| Treatment Time | 10 minutes |
| Additional Conditions | A portion of the workpiece was masked by covering with tape, and the plate-shaped abrasive was slid from the masked portion to the unmasked portion. |

Experimental Results

Measurement Device and Measurement Method

"Surfcom 130A", manufactured by Tokyo Seimitsu Co., Ltd., was employed as the shape and surface roughness measurement device, and the cross-sectional shape of the product to be treated was measured after being treated by the methods of Example 1 and Comparative Example 1, respectively (without grade corrections).

Measurement Results

Figure 2:
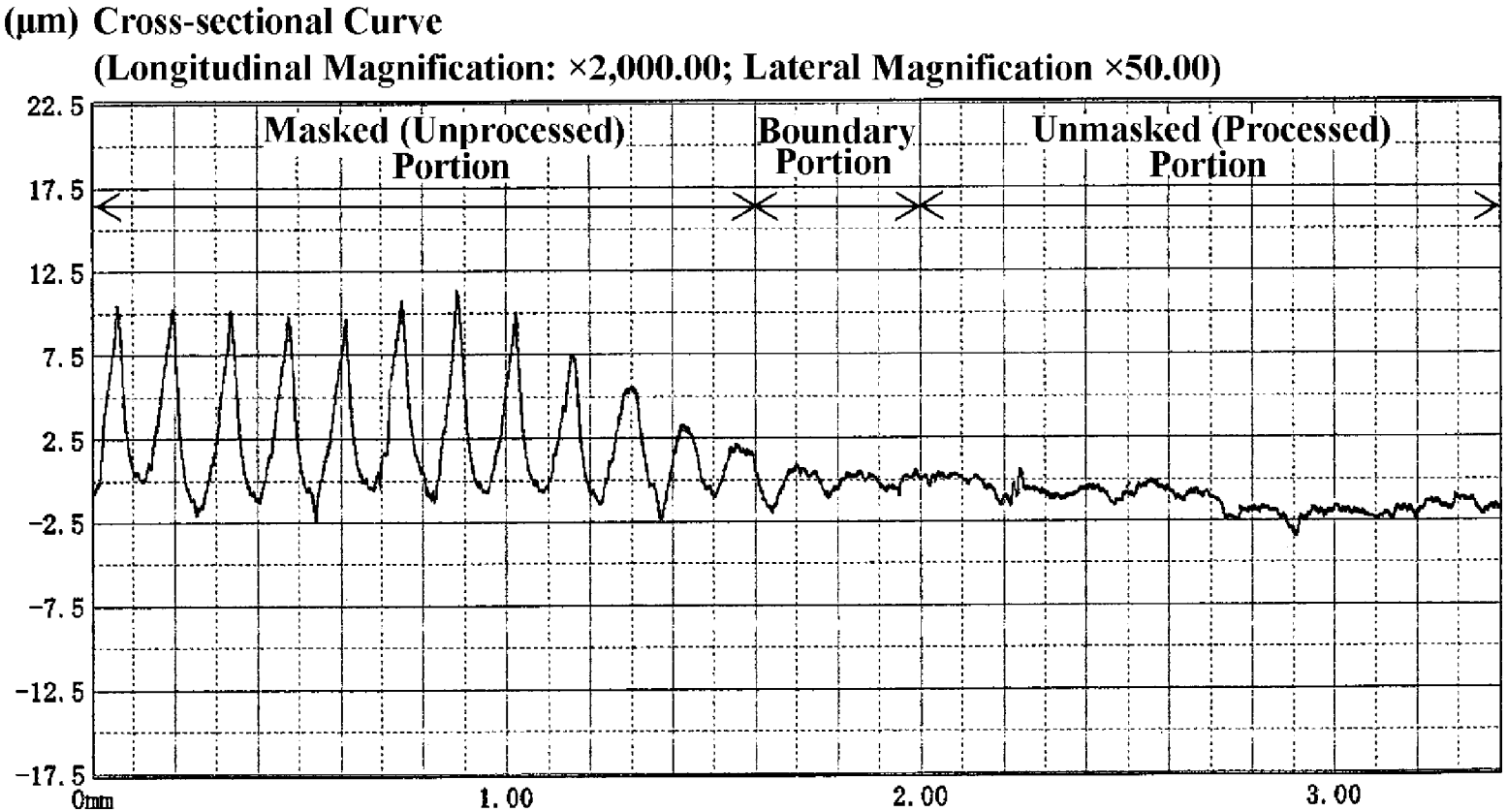
FIG. 2 is a graph showing a roughness curve for a surface shape of a product to be treated processed by a method according to Example 1.
Figure 4:
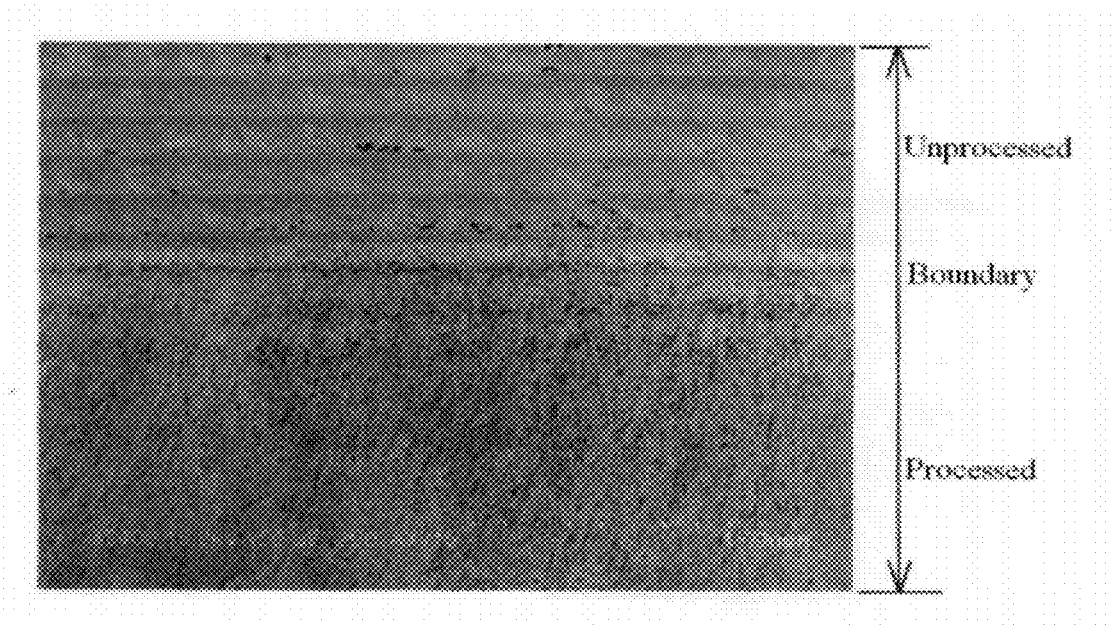
FIG. 4 is an enlarged photograph (50 times magnification) of the surface of a product to be treated processed by the method according to Example 1.

FIG. 2 is a graph showing a cross-sectional shape of the product to be treated processed by the method of Example 1; and FIG. 4 is an enlarged photograph of the surface of the product to be treated processed by the method of Example 1.

Figure 3:
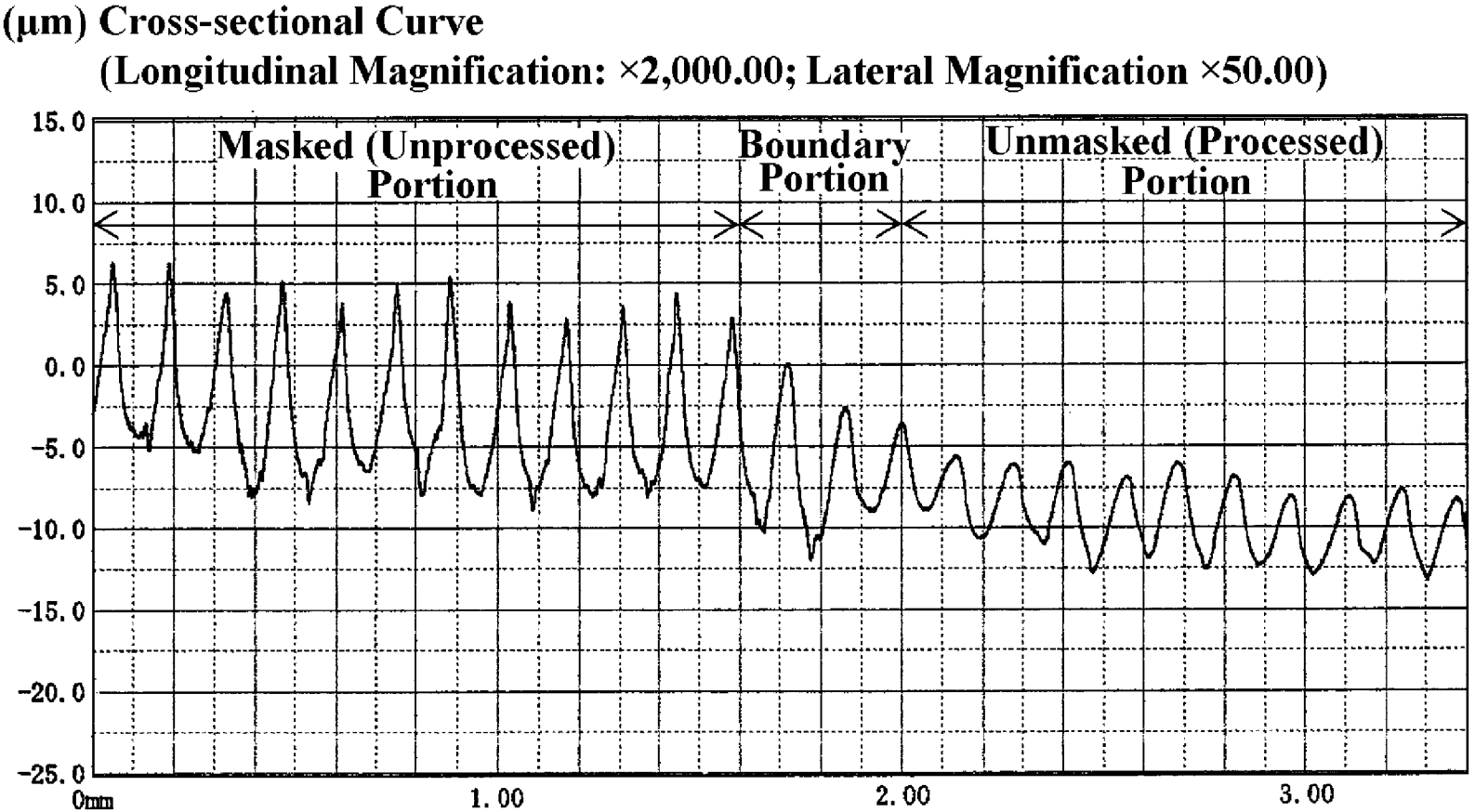
FIG. 3 is a graph showing a roughness curve for a surface shape of a product to be treated processed by a method according to Comparative Example 1.
Figure 5:
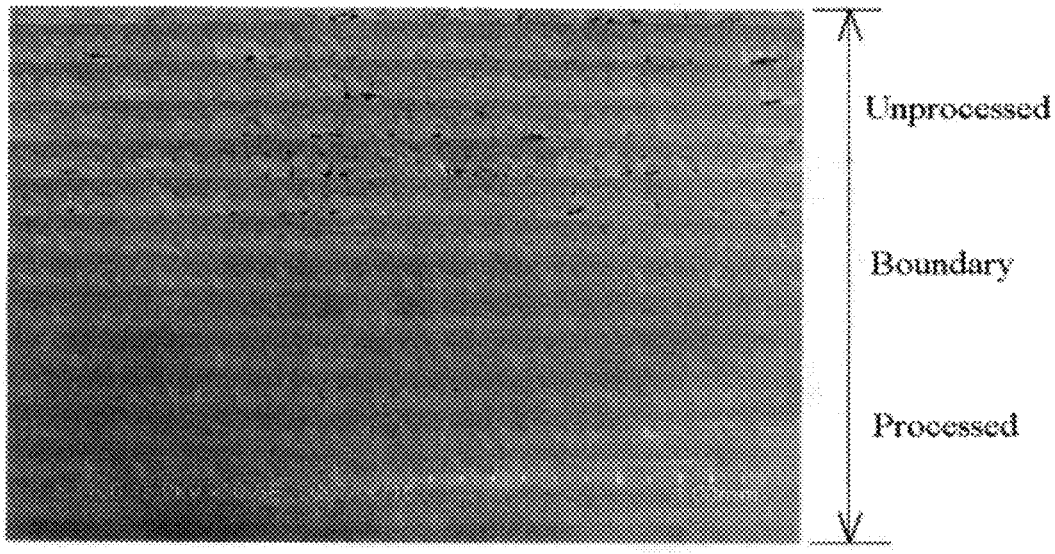
FIG. 5 is an enlarged photograph (50 times magnification) of the surface of a product to be treated processed by the method according to Comparative Example 1.

FIG. 3 is a graph showing a cross-sectional shape of the product to be treated processed by the method of Comparative Example 1; and FIG. 5 is an enlarged photograph of the surface of the product to be treated processed by the method of Comparative Example 1.

The region from approximately 1.60 mm to 2.00 mm on the horizontal axis in FIGS. 2 and 3 resulted from the masking described in Table 6, and represents the boundary portion between the masked and unmasked portions. In this portion, the adhesive material of the masking material was extruded by ejection, so that a pre-processed surface condition and a post-processed surface condition coexisted, with a gradual change from one to the other.

Accordingly, in FIGS. 2 and 3, the region to the left of 1.00 mm is the masked portion (the pre-processed portion), and the region to the right of 2.00 mm is the unmasked portion (the processed portion).

As shown in FIG. 2, in the product to be treated processed by employing the abrasive of the present invention, not only was it confirmed that the surface roughness of the processed portion was cut and smoothened, but with the exception of a localized region that was deepened at approximately 2.9 mm on the horizontal axis, it was also confirmed that in both the pre-processed portion or the processed portion, the maximum depth of the valleys of the surface roughness thereof was approximately −2.5 μm, and that there was almost no change in the depth of the valleys in the surface roughness, even after being processed.

Specifically, in blast processing employing the abrasive formed into a plate shape of the present invention, it was shown that the flattening of the product to be treated via the removal of only the peaks was performed without changing the depth of the valleys of the surface roughness.

Moreover, such flattening of the surface roughness may also be confirmed from the condition of the surface of the product to be treated shown in FIG. 4.

On the other hand, Comparative Example 1, in which the elastic abrasive with the grain shape was employed, confirms that the height from the bottom of a valley to the top of a peak of the surface roughness of the processed portion was reduced when compared with the unprocessed portion, and that the roughness thereof was reduced and flattened. However, the roughness of the processed portion (the height from the bottom of a valley to the top of a peak) was still significant when compared with the sample of Example 1.

Moreover, although the valleys of the surface roughness of the unprocessed portion of the sample treated by the method of Comparative Example 1 were in the vicinity of −7.5 μm, the valleys in the processed portion were deepened to approximately −12.5 μm. Accordingly, with regard to the process employing the elastic abrasive grain shape of Comparative Example 1, the elastic abrasive not only cut off the peaks of the surface roughness, but the valleys were likewise cut and deepened, so that while the abrasive was able to gradually smoothen the irregularities formed in response to the pitch-feed of the cutting tool at the time the cutting process was conducted, it was unable to eliminate these irregularities.

Moreover, with regard to the method described in Comparative Example 1, the fact that the irregularities in the surface of the product to be treated were not completely eliminated is also obvious from the condition of the surface of the product to be treated shown in FIG. 5.

Example 2

TABLE 7

| Abrasive (Example 2) | |
|---|---|
| Shape and size | 4 mm × 4 mm substantially square-shaped flat surface, Size etc. with a thickness of 0.2 mm |
| Plate diameter | 5.8 mm (average diameter of 100 randomly selected samples, as determined by SEM micrographs) |
| Plate Ratio | 29 (5.8 mm plate diameter/0.5 mm thickness)* |
| Carrier | Rubber carrier of dispersed abrasive grain type |
| Abrasive Grains | Green carborundum (GC) #8000 (average abrasive grain diameter of 1.2 μm), manufactured by Fuji Manufacturing Co., Ltd. |
| Production Method, etc. | A compounded material was obtained by adding and kneading compounding agent and abrasive grains to masticated rubber, with the abrasive grains being compounded at a weight ratio of 70% with respect to the total content of 100% of the mixture. A vulcanizing agent was added to the kneaded material, after that the kneaded material is formed into a sheet with 0.5 mm thick by an open roll. The resulting sheet was vulcanized then cut to produce the elastic abrasive. |

*The plate ratio was based on actual measurements via SEM observations.

Moreover, the plate diameter in the Table 2 is based on SEM micrographs of 100 randomly selected samples, with the plate diameter of each sample being measured as the diagonal length thereof, and the average value thereof determined as the above-mentioned plate diameter.

Moreover, the plate ratio was the value determined by dividing the average plate diameter value by the thickness.

Product to be Treated (Workpiece)

Table 8 shows the product to be treated employed as the object of processing by the present embodiment.

The product employed as the product to be treated (workpiece) of the present example was an SS400 round bar of a conventional structural rolled steel material with a diameter of 30 mm and a length of 45 mm, and the surface of the round bar was processed by a cutting tool of a cemented carbide allay on a lathe. The processed round bar that was employed had continuous cut-marks in the circumferential direction formed in parallel with a pitch of approximately 0.1 mm in the longitudinal direction.

Conditions of Blast Processing Employing Plate-Shaped Abrasive

The above-described abrasive was ejected onto the same product to be treated (workpiece) as described above and blast processing was conducted. The processing conditions of this blast processing are shown in Table 8.

TABLE 8

| Blast Processing Conditions (Example 2) | |
|---|---|
| Ejection Device | Air blasting device (gravity-type "SGSR-3"; manufactured by Fuji Manufacturing Co., Ltd.) |
| Ejection Pressure | 0.15 MPa |
| Ejection Distance | 80 mm |
| Ejection Angle | 60 degrees with respect to axis of the workpiece |
| Treatment Time | 5 minutes |
| Additional Conditions | A portion of the workpiece was masked by covering with tape, and the plate-shaped abrasive was slid from the masked portion to the unmasked portion. |

Processing Results

Visual observations of the processed portion confirmed that the roughness was reduced, and that the processed surface was provided with a smooth and glossy finish. Moreover, the convex portions (peaks) were selectively polished, and it was confirmed that the concave portions (valleys) were not processed. Specifically, in the blast processing employing the abrasive formed into the plate shape of the present invention, it was shown that the flattening of the product to be treated via the removal of only the peaks was performed without changing the depth of the valleys of the surface roughness.

Figure 6:
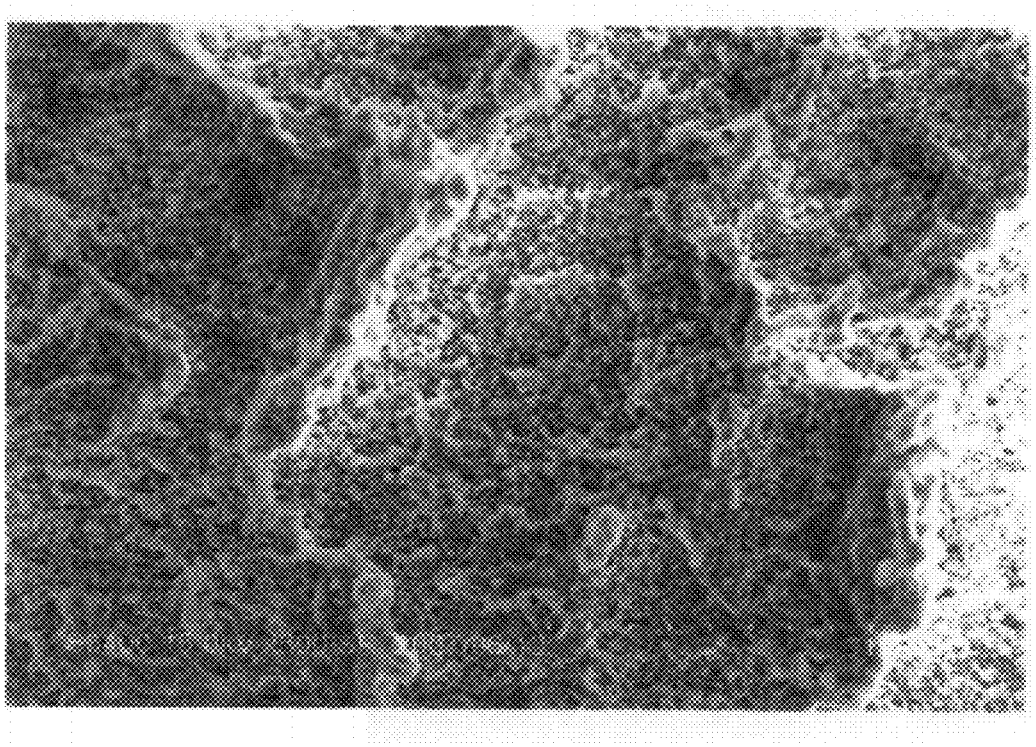
FIG. 6 is an electron micrograph (500 times magnification) of a surface of an dispersed abrasive grain type abrasive (rubber carrier) employed in Example 2.
Figure 7:
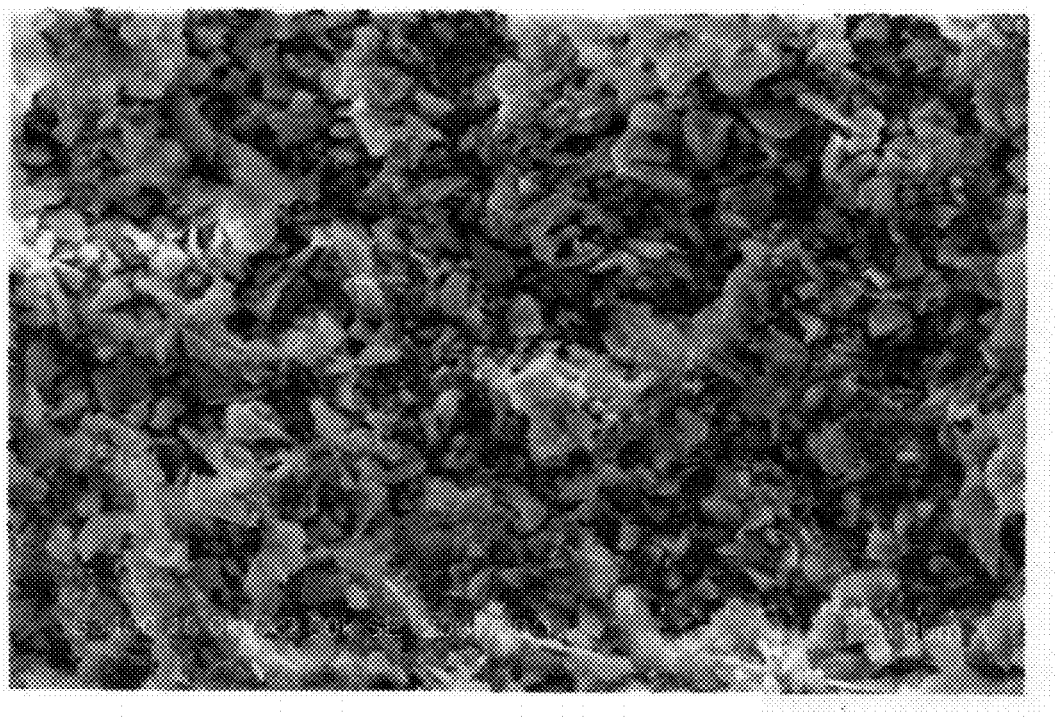
FIG. 7 is an electron micrograph (2000 times magnification) of the surface of the dispersed abrasive grain type abrasive (rubber carrier) employed in Example 2.
Figure 8:
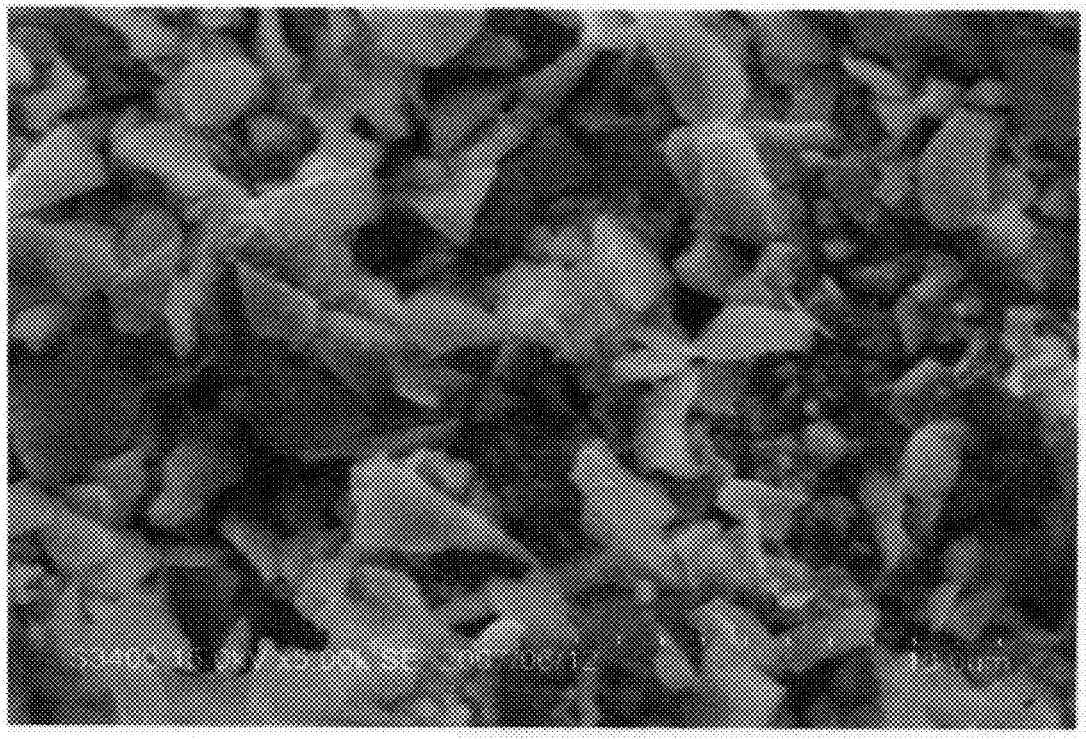
FIG. 8 is an electron micrograph (5000 times magnification) of the surface of the dispersed abrasive grain type abrasive (rubber carrier) employed in Example 2.

FIGS. 6 to 8 are electron micrographs of the surface of the abrasive (dispersed abrasive grain type; rubber carrier) employed by the blast processing method of the abovementioned Example 2.

As is clear from FIGS. 6 to 8 (especially, FIGS. 7 and 8), in the abrasive of Example 2 with the abrasive grain dispersed within the rubber carrier that is an elastic body, even after the abrasive was employed in blast processing, it was confirmed that a large amount of abrasive grain was retained in the surface thereof, and that shedding via the abrasive dropping off, etc., did not occur.

Accordingly, by maintaining a configuration in which a large amount of abrasive grains are carried on the surface of the carrier, even after being used, so that the carrier is cut when in contact with the product to be treated, even when abrasive grains exposed on the surface in contact with the surface of the product to be treated fall off, etc., it is thought that the abrasive grains embedded therewithin are newly exposed on the surface of the carrier, so that the abrasive grains that fell off are replaced by fresh abrasive grains, which are replenished within the surface thereof.

Accordingly, it was confirmed that the abrasive employed in Example 2 could be employed repetitively, without any deterioration in the abrasive force or cutting force thereof, even after being used.

Thus the broadest claims that follow are not directed to a machine that is configured in a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described;

What is claimed is:

1. An abrasive for blast processing comprising a plate-shaped carrier with a flat surface, and an abrasive grain carried on at least one side of the flat surface of the carrier wherein a maximum diameter of the flat surface thereof is in a range of 0.05 mm to 10 mm, the maximum diameter of the flat surface is at least three times an average interval of irregularities in a surface roughness of a processed surface of a product to be treated, the maximum diameter of the flat surface is 1.5 to 100 times a thickness of said abrasive, and wherein the abrasive is adapted to achieve a sliding orientation in which the flat surface of the abrasive makes slidable contact with the surface of the product to be treated, by ejecting the abrasive at an incident angle inclined with respect to the surface of a product to be treated.

2. The abrasive for blast processing according to claim 1, wherein the abrasive grain is carried on the carrier through an adhesive.

3. The abrasive for blast processing according to claim 1, wherein the carrier is an elastic body.

4. The abrasive for blast processing according to claim 1, wherein a colorant, such as a dye or a pigment, is compounded, or further added thereto a fluorescent colorant and/or an aromatic agent or an anti-bacterial agent.

5. A blast processing method comprising ejecting an abrasive comprising a plate-shaped carrier with a flat surface, and an abrasive grain carried on at least one side of the flat surface of the carrier wherein a maximum diameter of the flat surface is in a range of 0.05 mm to 10 mm, the maximum diameter of the flat surface is at least three times an average interval of irregularities in a surface roughness of a processed surface of a product to be treated, and the maximum diameter of the flat surface is 1.5 to 100 times a thickness of said abrasive, at an incident angle inclined with respect to a surface of a product to be treated, thereby the abrasive is capable to achieve a sliding orientation in which the flat surface of the abrasive makes slidable contact with the surface of the product to be treated.

6. The blast processing method according to claim 5, wherein the maximum diameter of the flat surface of the abrasive is at least ten times an average interval of irregularities in the surface roughness of a processed surface of the product to be treated.

7. The blast processing method according to claim 5, wherein the ejection of the abrasive is conducted at an incident angle of 0<80 degrees with respect to the product to be treated.

8. The blast processing method according to claim 6, wherein the ejection of the abrasive is conducted at an incident angle of 0<80 degrees with respect to the product to be treated.

9. The abrasive for blast processing according to claim 1, wherein the maximum diameter of the flat surface of the abrasive is at least ten times an average interval of irregularities in the surface roughness of a processed surface of the product to be treated.

10. The abrasive for blast processing according to claim 3, wherein the elastic body is a film or a sheet of rubber or resin.

11. The abrasive for blast processing according to claim 1, wherein the carrier is a film or a sheet of paper, cloth, non-woven fabric, plastic, or a fiber material.

12. The abrasive for blast processing according to claim 1, wherein the carrier is a plate or a foil composed of aluminum, tin, copper, zinc, iron or alloy thereof.

13. The abrasive for blast processing according to claim 1, wherein the carrier is a sheet of inorganic material of glass, alumina or ceramics.

* * * * *